US011395063B2

(12) United States Patent
Wang et al.

(10) Patent No.: US 11,395,063 B2
(45) Date of Patent: Jul. 19, 2022

(54) SPEAKER AND SOUND DIFFUSER THEREOF

(71) Applicant: Tymphany Acoustic Technology (Huizhou) Co., Ltd., Huizhou (CN)

(72) Inventors: Zhengmin Wang, Huizhou (CN); Le Pan, Huizhou (CN); Xiangfeng Jin, Huizhou (CN)

(73) Assignee: TYMPHANY ACOUSTIC TECHNOLOGY (HUIZHOU) CO., LTD., Huzhou (CN)

( * ) Notice: Subject to any disclaimer, the term of this patent is extended or adjusted under 35 U.S.C. 154(b) by 557 days.

(21) Appl. No.: 16/385,563

(22) Filed: Apr. 16, 2019

(65) Prior Publication Data

US 2019/0327554 A1 Oct. 24, 2019

(30) Foreign Application Priority Data

Apr. 19, 2018 (CN) ..... 201810351802.5

(51) Int. Cl.

| | |
|---|---|
| ***H04R 1/34*** | (2006.01) |
| ***H04R 1/32*** | (2006.01) |
| ***G10K 11/26*** | (2006.01) |
| *H04R 1/20* | (2006.01) |

(52) U.S. Cl.

CPC ..... *H04R 1/345* (2013.01); *G10K 11/26* (2013.01)

(58) Field of Classification Search

CPC . H04R 1/30; H04R 1/32; H04R 1/323; H04R 1/34; H04R 1/345; H04R 1/20; H04R 1/28; H04R 2201/34; G10K 11/18; G10K 11/20; G10K 11/26; G10K 11/28

See application file for complete search history.

(56) References Cited

U.S. PATENT DOCUMENTS

| | | | | | |
|---|---|---|---|---|---|
| 4,134,471 | A * | 1/1979 | Queen | H04R 1/345 | 181/145 |
| 4,348,549 | A * | 9/1982 | Berlant | H04R 1/26 | 181/152 |
| 5,115,882 | A * | 5/1992 | Woody | H04R 1/345 | 181/144 |
| 5,673,329 | A * | 9/1997 | Wiener | H04R 1/34 | 181/144 |

(Continued)

FOREIGN PATENT DOCUMENTS

| | | | | |
|---|---|---|---|---|
| DE | 4331959 C2 * | 10/1996 | ..... | H04R 1/345 |
| EP | 518668 A2 * | 12/1992 | ..... | H04R 1/34 |

(Continued)

*Primary Examiner* — Edgardo San Martin

(74) *Attorney, Agent, or Firm* — Muncy, Geissler, Olds & Lowe, P.C.

(57) ABSTRACT

This application provides a speaker and a sound diffuser thereof. The sound diffuser includes a first diffusion surface and a second diffusion surface. The first diffusion surface faces toward a first driver, and has a first central area that is a circular protrusion, a first outer ring region, and a first concave ring region located between the first central area and the first outer ring region. The second diffusion surface faces toward a second driver, and is a circular dish surface protuberant from center outwards. The sound diffuser is coaxially located between the first driver and the second driver, and the first driver and the second driver respectively generate different sound production frequencies.

10 Claims, 8 Drawing Sheets

(56) References Cited

U.S. PATENT DOCUMENTS

| | | | | | |
|---|---|---|---|---|---|
| 5,721,401 | A * | 2/1998 | Sim | H04R 1/345 | 181/148 |
| 5,995,634 | A * | 11/1999 | Zwolski | H04R 1/028 | 181/155 |
| 6,257,365 | B1 * | 7/2001 | Hulsebus, II | G10K 11/28 | 181/155 |
| 6,603,862 | B1 * | 8/2003 | Betts | H04R 1/345 | 181/155 |
| 2003/0179899 | A1 * | 9/2003 | Welker | H04R 1/02 | 381/386 |
| 2004/0020711 | A1 * | 2/2004 | China | H04R 1/36 | 181/176 |
| 2012/0201403 | A1 * | 8/2012 | Tan | H04R 1/345 | 381/182 |
| 2016/0227315 | A1 * | 8/2016 | Kim | H04R 1/288 | |
| 2017/0064421 | A1 * | 3/2017 | Matsumura | H04R 9/046 | |
| 2017/0303034 | A1 * | 10/2017 | Sullivan | H04R 1/345 | |
| 2020/0053454 | A1 * | 2/2020 | Pan | H04R 7/127 | |
| 2020/0158866 | A1 * | 5/2020 | Liu | G01S 15/86 | |

FOREIGN PATENT DOCUMENTS

| | | | | |
|---|---|---|---|---|
| EP | 0605224 | A1 * | 7/1994 | H04R 1/345 |
| FR | 3066673 | A1 * | 11/2018 | H04R 1/345 |
| GB | 2310565 | A * | 8/1997 | H04R 1/34 |
| GB | 2317532 | A * | 3/1998 | H04R 1/345 |
| GB | 2459338 | A | 10/2009 | |
| WO | WO-2011053248 | A1 * | 5/2011 | H04R 1/345 |
| WO | WO-2015094115 | A1 * | 6/2015 | H04R 1/20 |

* cited by examiner

SPEAKER AND SOUND DIFFUSER THEREOF

BACKGROUND

Technical Field

This application relates to a speaker and a sound diffuser thereof, and in particular, to a speaker that has both a tweeter and a woofer and a sound diffuser thereof.

Related Art

A sound diffuser is used for a driver of a loudspeaker, and is used to change sound transmission paths that are various of frequency ranges and that are generated by different drivers. It helps better radiating sounds to a free field around a loudspeaker, thereby increasing sound pressure levels and sound radiation efficiency in various frequency bands with 360 degrees directions.

Currently, loudspeakers with sound diffusers are basically designed with corresponding drivers for different sound frequency bands. It separately designs corresponding sound diffusers and dedicated sound production space locations. Generally, a sound radiation surface of a bass sound diffuser is mainly a spherical surface, and a sound radiation surface of a treble sound diffuser is mainly a pointed cone surface. As shown in the GB2459338A, sound production spaces of treble and bass speakers are separately designed, so that there is a distance between a treble sound production space and a bass sound production space.

However, when a loudspeaker with a plurality of drivers integrated into a box needs to be designed, if each driver respectively has one sound production space, a relatively large space of the loudspeaker is occupied. This is not acceptable for a speaker that has a limited space. Therefore, a sound diffuser shared by a plurality of drivers needs to be developed, and a speaker system needs also to be improved to achieve an optimal acoustic characteristic.

SUMMARY

In view of this, this disclosure provides a sound diffuser used in a speaker. The sound diffuser is coaxially located between a first driver and a second driver, and the sound diffuser includes a first diffusion surface and a second diffusion surface. The first diffusion surface faces toward a first driver, and has a first central area that is a circular protrusion, a first outer ring region, and a first concave ring region located between the first central area and the first outer ring region. The second diffusion surface faces toward a second driver, and is a circular dish surface protuberant from center outwards.

This disclosure further provides an embodiment, where the second diffusion surface has a second central area, which is a circular protrusion, and a diameter of the first central area of the first diffusion surface is greater than the second central area of the second diffusion surface.

In an embodiment, the second diffusion surface has a second concave ring surface, and a diameter of the second concave ring surface is less than a diameter of the first concave ring region of the first diffusion surface.

This disclosure further provides an embodiment, where the second diffusion surface has a second central area, which is protuberant in a pointed cone.

In an embodiment, the second diffusion surface has a second central area, which is protuberant in a straight cone.

This disclosure further provides an embodiment, where the second diffusion surface has a second central area, which is protuberant in a circular convex cone.

In an embodiment, the sound diffuser is hollow, and the first diffusion surface has a plurality of openings.

In another embodiment, inner surfaces or outer surfaces of the plurality of openings of the first diffusion surface have damping layers.

This disclosure further provides a speaker, including a first driver, a second driver, and the sound diffuser according to embodiments of this application. A sound production frequency of the second driver is different from that of the first driver. The sound diffuser includes a first diffusion surface and a second diffusion surface. The first diffusion surface faces toward a first driver, and has a first central area that is a circular protrusion, a first outer ring region, and a first concave ring region located between the first central area and the first outer ring region. The second diffusion surface faces toward a second driver, and is a circular dish surface protuberant from center outwards.

The speaker and the sound diffuser thereof according to the embodiments of this application can enable sound production spaces of the first driver and the second driver to become smaller, and can still simultaneously diffuse sound waves that are from the first driver and the second driver. A single sound diffuser can reduce mutual impact between sound fields in the sound production spaces of the first driver and the second driver to the minimum, and can improve a direction of a sound (for example, traveling in a horizontal direction), to achieve an optimal acoustic characteristic for a speaker.

BRIEF DESCRIPTION OF THE DRAWINGS

The present invention will become more fully understood from the detailed description given herein below for illustration only, and thus are not limitative of the present invention, and where.

DETAILED DESCRIPTION

To facilitate reading, this document points out "upper", "lower", "left", and "right" according to the figures. Its objective is to point out relative reference locations of components, but not to limit this application.

Figure 1:
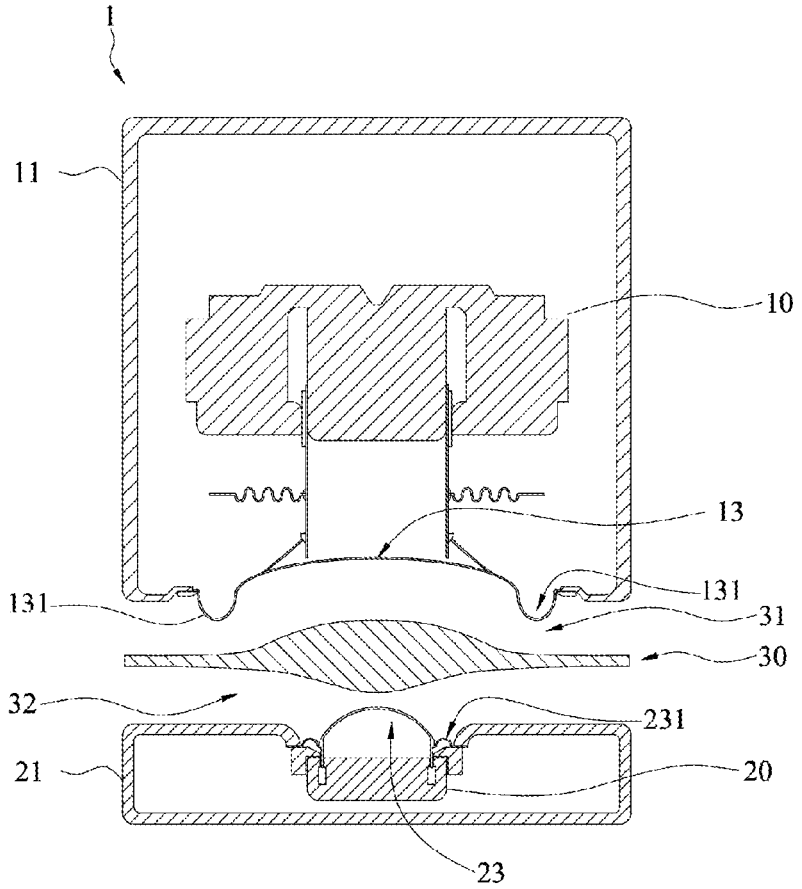
FIG. 1 is a schematic sectional diagram of a speaker and a sound diffuser thereof according to an embodiment of this application.

FIG. 1 is a schematic sectional diagram of a speaker 1 and a sound diffuser 30 thereof according to an embodiment of this application. The speaker 1 in this application mainly includes a first driver 10, a second driver 20, and a sound diffuser 30. The first driver 10 and the second driver 20 are mutually coaxially disposed, and the sound diffuser 30 is also coaxially disposed between the upper first driver 10 and the lower second driver 20.

The first driver 10 is disposed inside a hollow first cavity 11, the second driver 20 is disposed inside a hollow second cavity 21, and the sound diffuser 30 is disposed between the first cavity 11 and the second cavity 21. The sound diffuser 30 to be coaxially disposed between the upper first driver 10 and the lower second driver 20. For the convenience of description, a support (not shown) that fastens the sound diffuser 30 between the first driver 10 (the first cavity 11) and the second driver 20 (the second cavity 21) is not displayed may be implemented by using any structure design that can accommodate the sound diffuser 30 in this application and satisfy a sound diffusion function requirement thereof.

For example, the first driver 10 may be a woofer, and a sound production direction of the woofer faces toward the sound diffuser 30. In an embodiment, a sound frequency range of the first driver 10 is approximately 40 Hz to 2,000 Hz. The first driver 10 has a first vibration film 13, and at a location close to its outter edge, there is a coaxially disposed round first folding ring 131 that protrudes toward the sound diffuser 30. A sound production frequency of the second driver 20 is different that of the first driver 10. For example, the second driver 20 may be a tweeter, and a sound production direction thereof faces toward the sound diffuser 30. In an embodiment, a sound frequency range of the second driver 20 is approximately 2,000 Hz to 20,000 Hz. The second driver 20 has a second vibration film 23, and at a location close to its outter edge, there is a coaxially disposed round second folding ring 231 that protrudes toward the sound diffuser 30.

Figure 2:
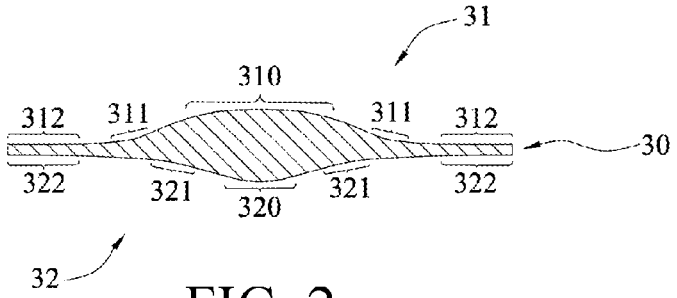
FIG. 2 is a schematic sectional diagram of the sound diffuser in FIG. 1.

FIG. 2 is a schematic cross-sectional diagram of the sound diffuser in FIG. 1. Refer to both FIG. 1 and FIG. 2. Between the first cavity 11 and the second cavity 21 are sound production spaces of the first driver 10 and the second driver 20. The sound diffuser 30 separates the sound production spaces, so that sound waves from both the first driver 10 and the second driver 20 can be simultaneously diffused. The influences between sound fields in the two sound production spaces of the first driver 10 and the second driver 20 can be reduced to the minimum, thereby reducing or even eliminating intermodulation distortion generated between the sound fields in two sound production frequency bands. The sound diffuser 30 may be in the shape of a circular dish protuberant from center outwards. The sound diffuser 30 is configured to change a diffusion direction of a sound wave. The sound diffuser 30 includes a first diffusion surface 31 and a second diffusion surface 32. The first diffusion surface 31 faces toward the first driver 10, the second diffusion surface 32 faces toward the second driver 20, and surface curvatures of the first diffusion surface 31 and the second diffusion surface 32 are different.

The first diffusion surface 31 has a first central area 310 that is a circular protrusion, a first outer ring region 312 that is approximately horizontal flat, and a first concave ring region 311 located between the first central area 310 and the first outer ring region 312. The first central area 310, the first concave ring region 311, and the first outer ring region 312 of the first diffusion surface 31 smoothly transit at adjacent locations thereof, and are mutually coaxially disposed corresponding to the first vibration film 13 of the first driver 10. At least one part of the first central area 310 of the first diffusion surface 31 is corresponding to a cambered surface of the first vibration film 13 of the first driver 10. A location of the first diffusion surface 31 is a maximum physical stroke location corresponding to the first vibration film 13 of the first driver 10, that is, a vertical distance between the first diffusion surface 31 and the first folding ring 131 is equal to or greater than a maximum physical stroke generated by the first folding ring 131.

The second diffusion surface 32 is in the shape of a circular dish surface protuberant from center outwards. The second diffusion surface 32 has a second central area 320 that is a circular protrusion, an approximately horizontal second outer ring region 322 and a second concave ring region 321 located between the second central area 320 and the second outer ring region 322. The second central area 320, the second concave ring region 321, and the second outer ring region 322 of the second diffusion surface 32 smoothly transit at adjacent locations thereof, and are mutually coaxially disposed corresponding to the second vibration film 23 of the second driver 20.

A sound wave (for example, a bass sound wave) that is toward the sound diffuser 30 from the first driver 10 is diffused outward (for example, horizontally diffused outward), and the first diffusion surface 31 of the sound diffuser 30 changes a direction of the sound wave. Similarly, a sound wave (for example, a treble sound wave) that is toward the sound diffuser 30 from the second driver 20 is diffused outward (for example, horizontally diffused outward), and the second diffusion surface 32 of the sound diffuser 30 changes a direction of the sound wave.

Referring to both FIG. 1 and FIG. 2, in an embodiment, a diameter of the first concave ring region 311 of the first diffusion surface 31 is less than or equal to a diameter of the first folding ring 131 of the first driver 10. In another embodiment, a diameter of the second concave ring surface 321 of the second diffusion surface 32 of the sound diffuser 30 is less than a diameter of the first concave ring region 311 of the first diffusion surface 31. In some embodiments, a diameter of the first central area 310 of the first diffusion surface 31 of the sound diffuser 30 is greater than the second central area 320 of the second diffusion surface 32.

Figure 3A:
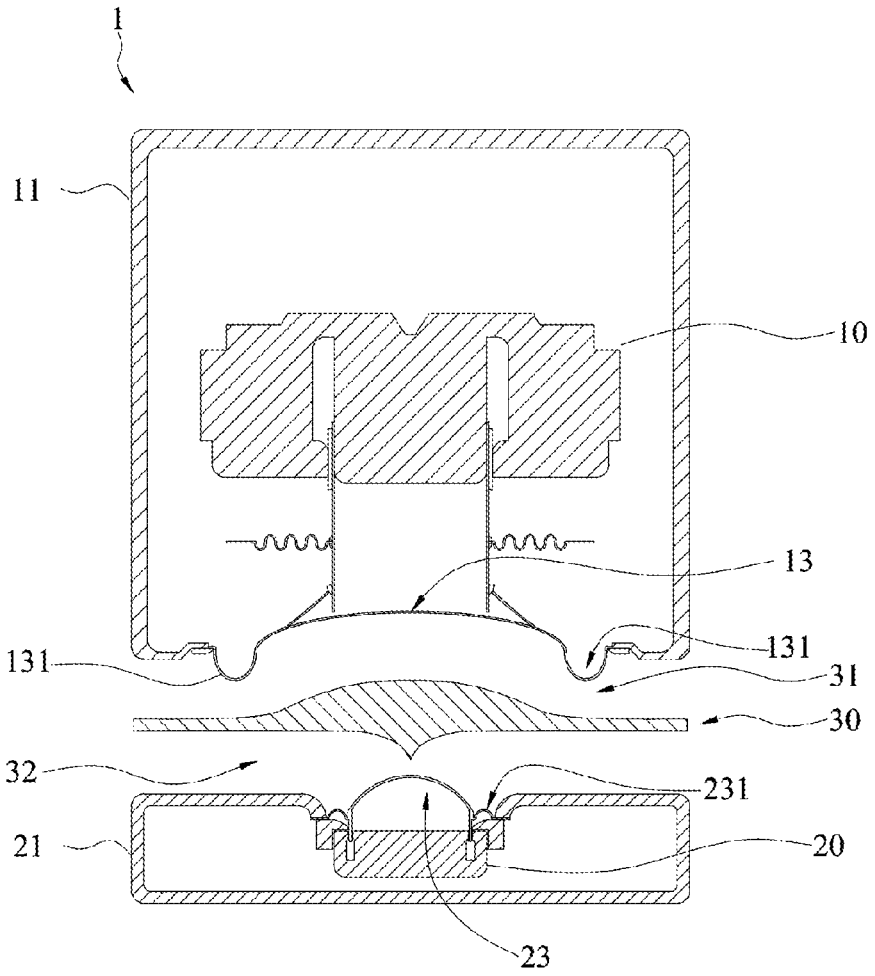
FIG. 3A is a schematic sectional diagram of a speaker and a sound diffuser thereof according to another embodiment of this application.
Figure 3B:
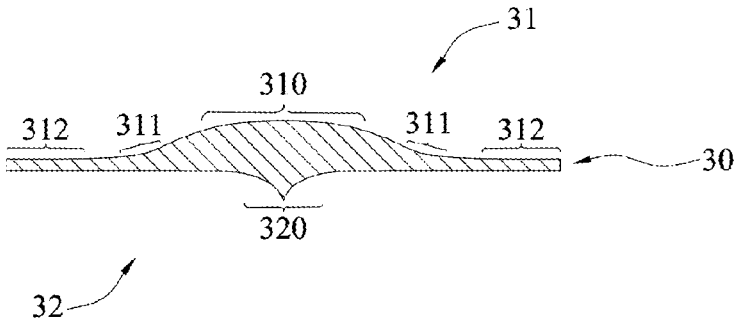
FIG. 3B is a schematic sectional diagram of the sound diffuser in FIG. 3A.

Referring to both FIG. 3A and FIG. 3B, FIG. 3A is a schematic sectional diagram of a speaker and a sound diffuser thereof according to another embodiment of this application, and FIG. 3B is a schematic sectional diagram of the sound diffuser in FIG. 3A. In addition to the foregoing embodiments, there are also other implementations in which preferable acoustic characteristic performance of the speaker and the sound diffuser thereof in this application is achieved. In FIG. 3A and FIG. 3B, a structure of the first diffusion surface 31 of the sound diffuser 30 is the same as that in FIG. 1 and FIG. 2. A difference is that, in FIG. 3A and FIG. 3B, the second central area 320 of the second diffusion surface 32 of the sound diffuser 30 is a protuberant pointed cone formed by a concave surface, and the second diffusion surface 32 outside the second central area 320 is an approximately flat surface.

Figure 4A:
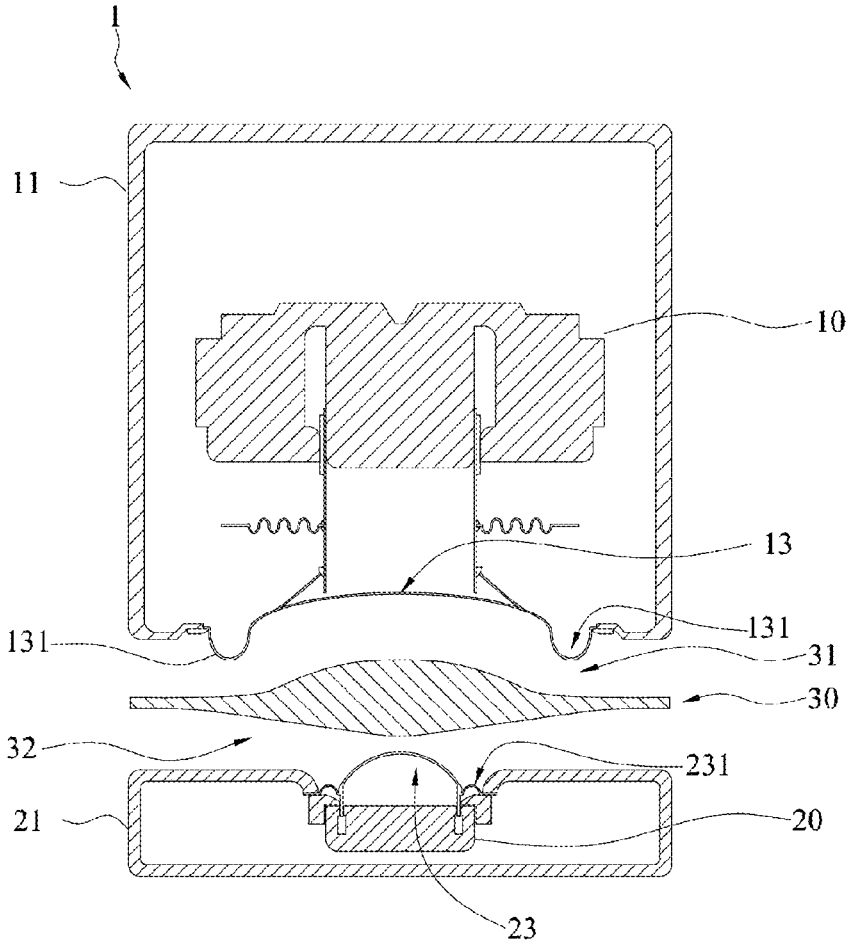
FIG. 4A is a schematic sectional diagram of a speaker and a sound diffuser thereof according to still another embodiment of this application.
Figure 4B:
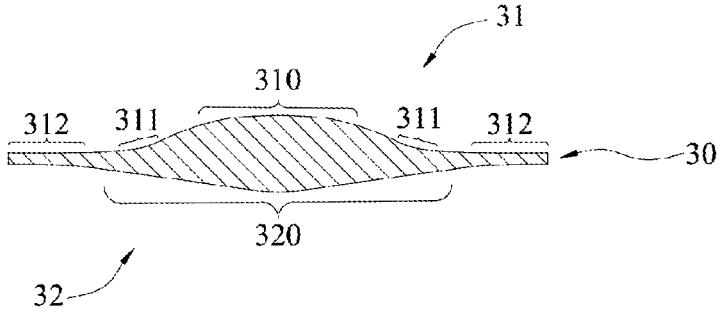
FIG. 4B is a schematic sectional diagram of the sound diffuser in FIG. 4A.

Referring to both FIG. 4A and FIG. 4B, FIG. 4A is a schematic sectional diagram of a speaker and a sound diffuser thereof according to still another embodiment of this application, and FIG. 4B is a schematic sectional diagram of the sound diffuser in FIG. 4A. In addition to the foregoing embodiments, there are also other implementations in which preferable acoustic characteristic performance of the speaker and the sound diffuser thereof in this application is achieved. In FIG. 4A and FIG. 4B, a structure of the first diffusion surface 31 of the sound diffuser 30 is the same as that in FIG. 1 and FIG. 2. A difference is that, in FIG. 4A and FIG. 4B, the second central area 320 of the second diffusion surface 32 of the sound diffuser 30 is a protuberant straight cone formed by a flat surface.

Figure 5A:
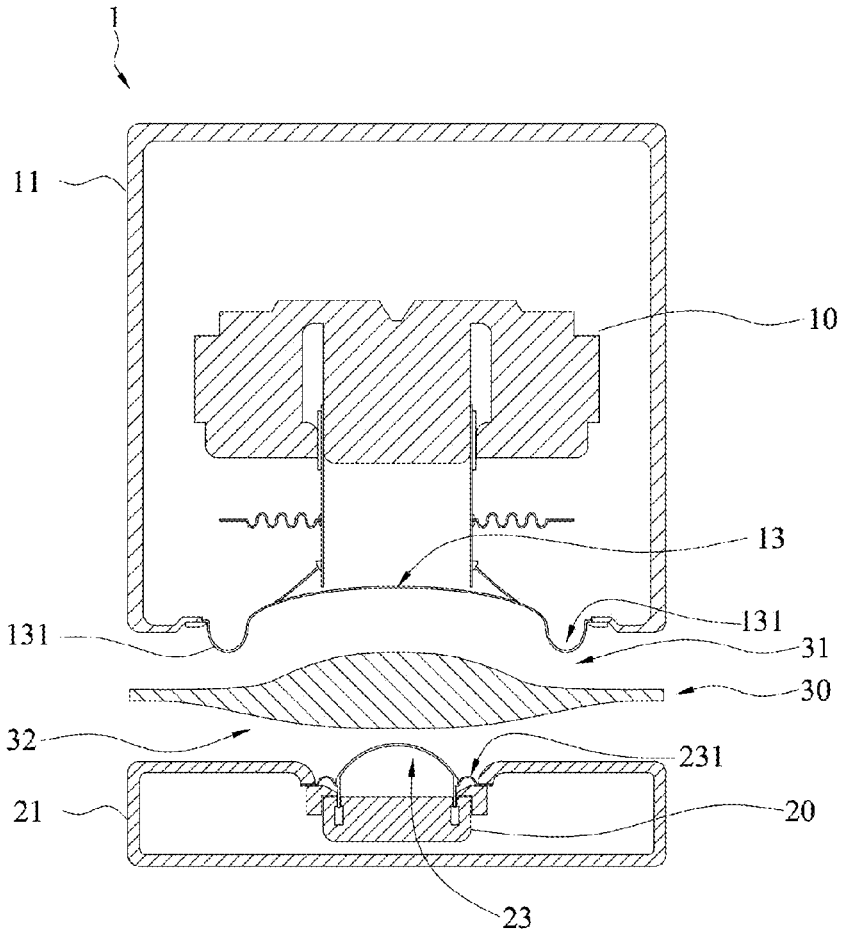
FIG. 5A is a schematic sectional diagram of a speaker and a sound diffuser thereof according to yet another embodiment of this application.
Figure 5B:
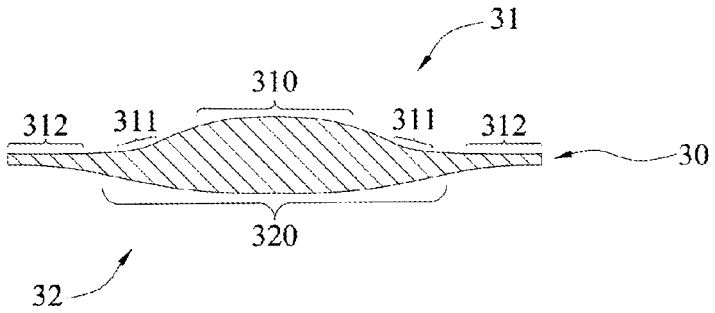
FIG. 5B is a schematic sectional diagram of the sound diffuser in FIG. 5A.

Referring to both FIG. 5A and FIG. 5B, FIG. 5A is a schematic sectional diagram of a speaker and a sound diffuser thereof according to yet another embodiment of this application, and FIG. 5B is a schematic sectional diagram of the sound diffuser in FIG. 5A. In addition to the foregoing embodiments, there are also other implementations in which preferable acoustic characteristic performance of the speaker and the sound diffuser thereof in this application is achieved. In FIG. 5A and FIG. 5B, a structure of the first diffusion surface 31 of the sound diffuser 30 is the same as that in FIG. 1 and FIG. 2. A difference is that, in FIG. 5A and FIG. 5B, the second central area 320 of the second diffusion surface 32 of the sound diffuser 30 is a protuberant circular convex cone formed by a round surface.

Figure 6:
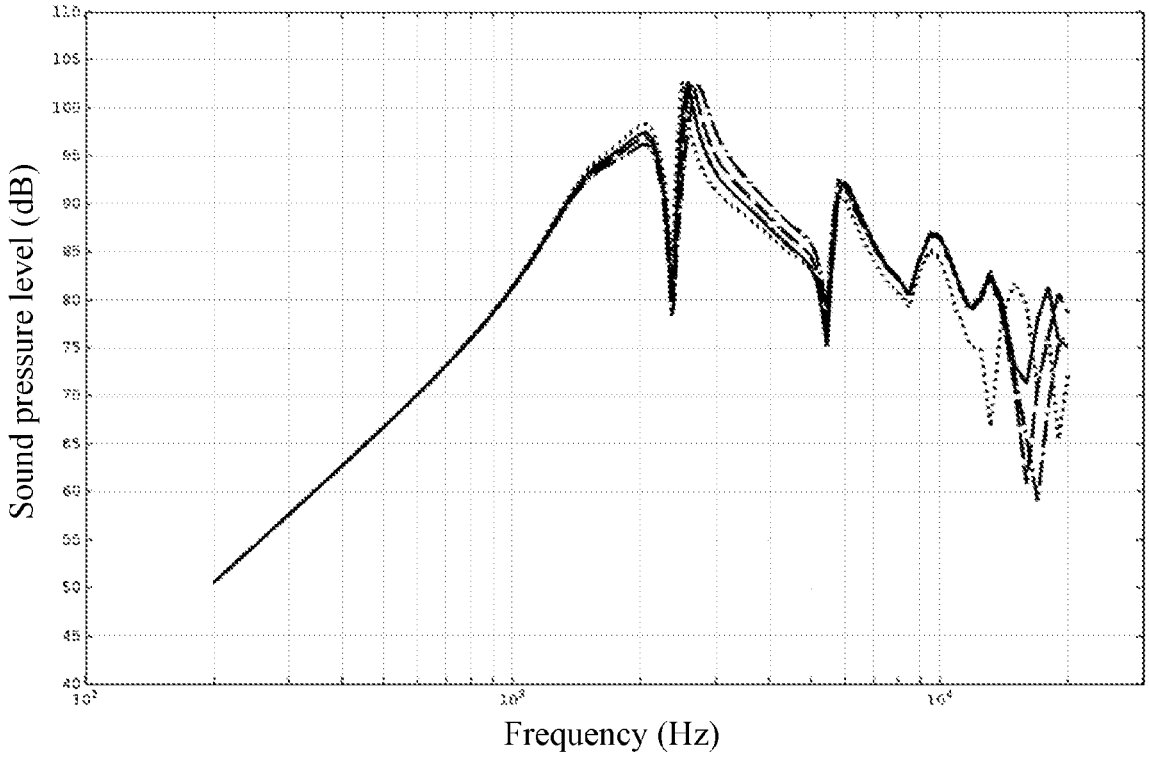
FIG. 6 is a frequency-response curve diagram of simulating the sound diffuser in FIG. 2A, FIG. 3B, FIG. 4B, and FIG. 5B.

FIG. 6 is a frequency-response curve diagram of the sound diffuser in FIG. 2A, FIG. 3B, FIG. 4B, and FIG. 5B, simulating a frequency response of the second driver 20 (for example, a tweerter) at a location which is one meter away from a horizontal middle location of the sound diffuser 30. A dotted line " . . . " indicates the sound diffuser 30, shown in FIG. 3B, whose second central area 320 is a pointed cone; a solid line "-" indicates the sound diffuser 30 shown in FIG. 2; a dashed line "---" indicates the sound diffuser 30, shown in FIG. 4B, whose second central area 320 is a straight cone; a dot dash line "-.-" indicates the sound diffuser 30, shown in FIG. 5B, whose second central area 320 is a circular convex cone.

It can be learned from FIG. 6 that, when a frequency is less than 10 kHz, trends of four sound pressure level curves are slightly different, and all have one valley at 2.3 kHz and one valley at 5.4 kHz, and frequency bandwidth of the valleys is approximately 500 Hz; in a frequency band of 10 kHz to 20 kHz, a sound pressure level curve of the sound diffuser 30, shown in FIG. 5B, whose second central area 320 is a circular convex cone is most flat. Overall, treble acoustic characteristic performance of the sound diffuser 30, shown in FIG. 5B, whose second central area 320 is a circular convex cone is optimal. The second diffusion surface 32 of the sound diffuser 30 mainly affects a sound pressure level curve of a frequency band equal to or greater than 10 kHz.

Figure 7A:
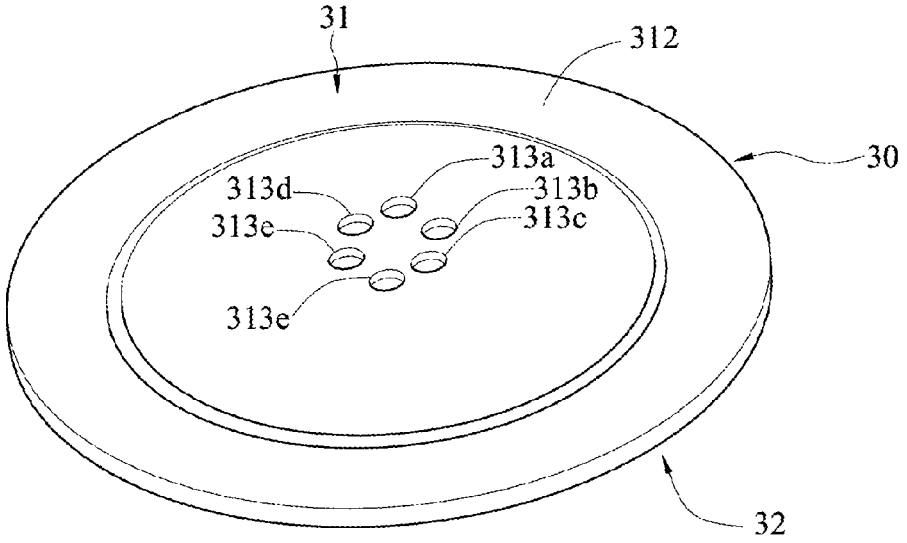
FIG. 7A is a stereoscopic appearance diagram of a sound diffuser according to another embodiment of this application.
Figure 7B:
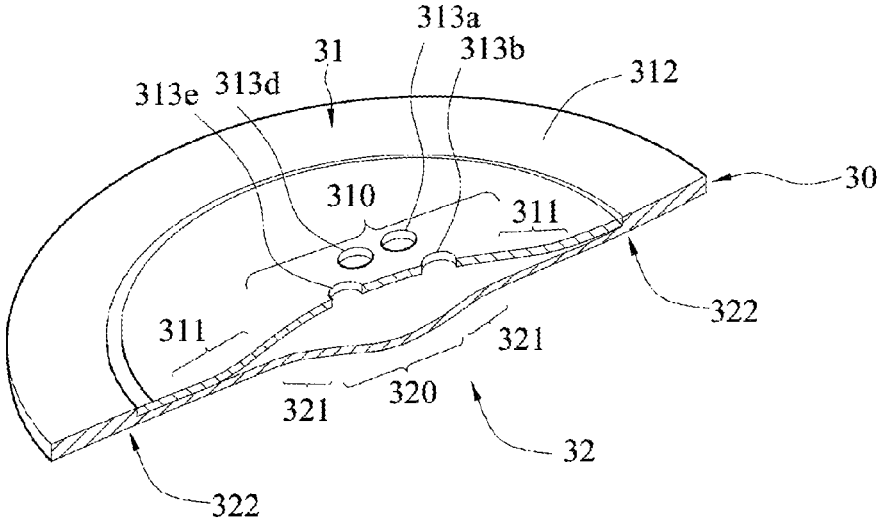
FIG. 7B is a stereoscopic sectional view of a sound diffuser according to another embodiment of this application.

Referring to FIG. 7A and FIG. 7B, FIG. 7A and FIG. 7B are a stereoscopic appearance diagram and a stereoscopic sectional view of a sound diffuser according to another embodiment of this application. To eliminate valleys at 2.3 kHz and 5.4 kHz, another embodiment of this application further provides a hollow sound diffuser 30 with porous. As shown in FIG. 7A and FIG. 7B, the sound diffuser 30 is hollow having six openings 313*a*, 313*b*, 313*c*, 313*d*, 313*f*, and 313*e* provided in the first central area 310 of the first diffusion surface 31 (bass) of the sound diffuser 30. In an embodiment, for example, the openings 313*a*, 313*b*, 313*c*, 313*d*, 313*f*, and 313*e* may be circular, equal in diameter, and symmetrically arranged. The sound diffuser 30 is equivalent to a Helmholtz resonator. The Helmholtz resonator usually has relatively narrow sound absorption bandwidth, and absorbs maximum energy at a resonance frequency. Sound absorption performance of the Helmholtz resonator at a non-resonance frequency rapidly decreases, and the Helmholtz resonator is suitable for controlling over narrow band sound transmission. When a size of the Helmholtz resonator is far less than a wavelength of a sound wave of its resonance frequency, all gas particles within the neck may be considered as "mass blocks", and gas within a cavity is considered as a "spring", thereby forming a spring-mass system, that is, a classic concentrated parameter model. Then, a mechanical model of the Helmholtz resonator may be simplified as a concentrated mass-spring system with a single degree of freedom. A theoretical resonance frequency formula of the sound diffuser 30 that is used as the Helmholtz resonator in FIG. 7A and FIG. 7B is as follows:

$$f = \frac{c}{2\pi}\sqrt{\frac{S}{L*V}}$$

where, c is a sound speed, S is areas of openings in the neck (that is, areas of the individual openings 313*a*, 313*b*, 313*c*, 313*d*, 313*f*, and 313*e*), L is an effective length of the neck (that is, a depth of the individual openings 313*a*, 313*b*, 313*c*, 313*d*, 313*f*, and 313*e*), and V is a volume of a cavity (that is, a hollow volume of the sound diffuser 30).

Figure 7C:
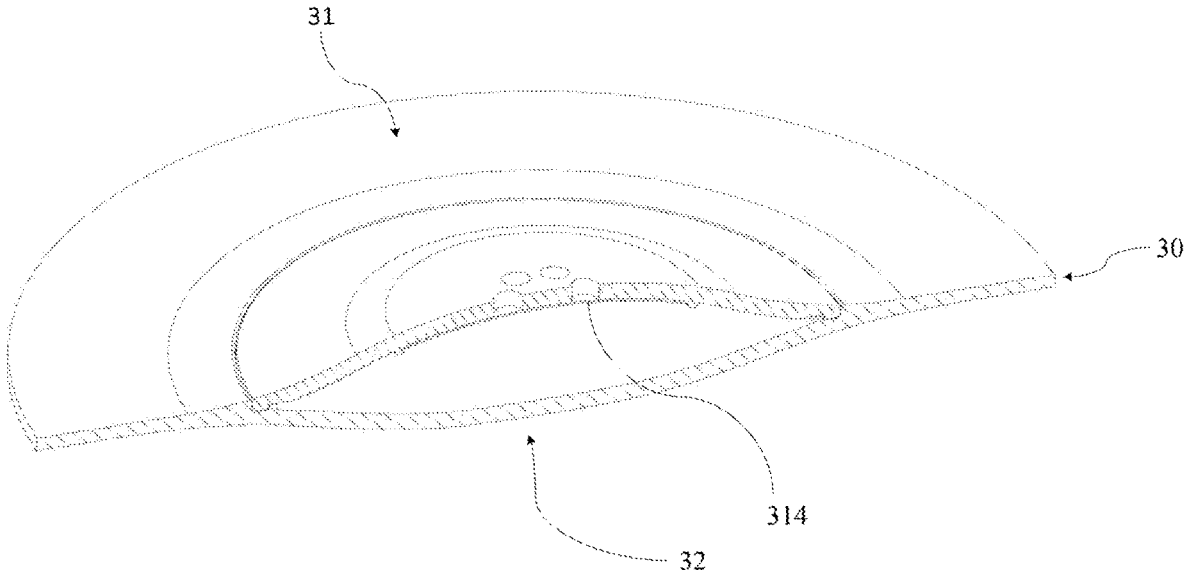
FIG. 7C is a stereoscopic sectional view of a sound diffuser according to another embodiment of this application.
Figure 7D:
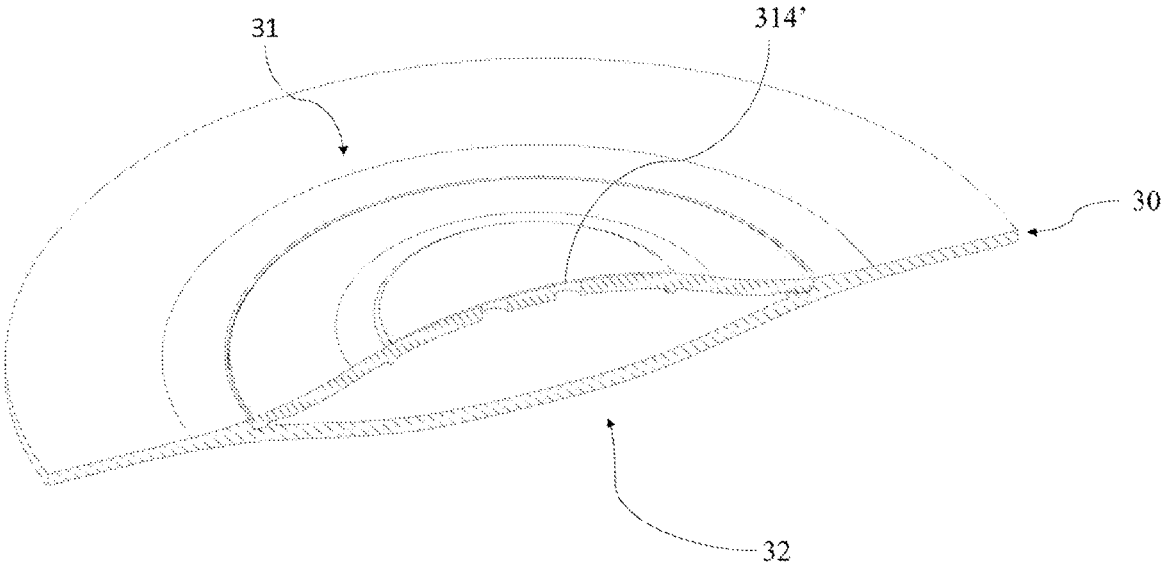
FIG. 7D is a stereoscopic sectional view of a sound diffuser according to another embodiment of this application.

In FIG. 7A and FIG. 7B, the total area of the openings 313*a*, 313*b*, 313*c*, 313*d*, 313*f*, and 313*e* of the sound diffuser 30 at the first diffusion surface 31 (bass) needs to be properly coordinated with the hollow volume of the sound diffuser, and damping layer(s) 314, 314' (shown in FIG. 7C and FIG. 7D) are added to locations of inner surfaces or outer surfaces of the openings 313*a*, 313*b*, 313*c*, 313*d*, 313*f*, and 313*e*. The damping layers 314, 314' may be implemented by respectively disposing mesh cloths on the openings 313*a*, 313*b*, 313*c*, 313*d*, 313*f*, and 313*e*, and the mesh cloths used as the damping layers 314, 314' cover the inner surfaces or the outer surfaces of the openings 313*a*, 313*b*, 313*c*, 313*d*, 313*f*, and 313*e*. To adjust the damping coefficient of the damping layers, the ratio of the openings of the mesh cloths used as the damping layers may be adjusted and the sizes of the openings 313*a*, 313*b*, 313*c*, 313*d*, 313*f*, and 313*e* may be adjusted. In this way, a proper resonance frequency and the Helmholtz resonator with damping may be designed to serve as the sound diffuser 30.

Figure 8:
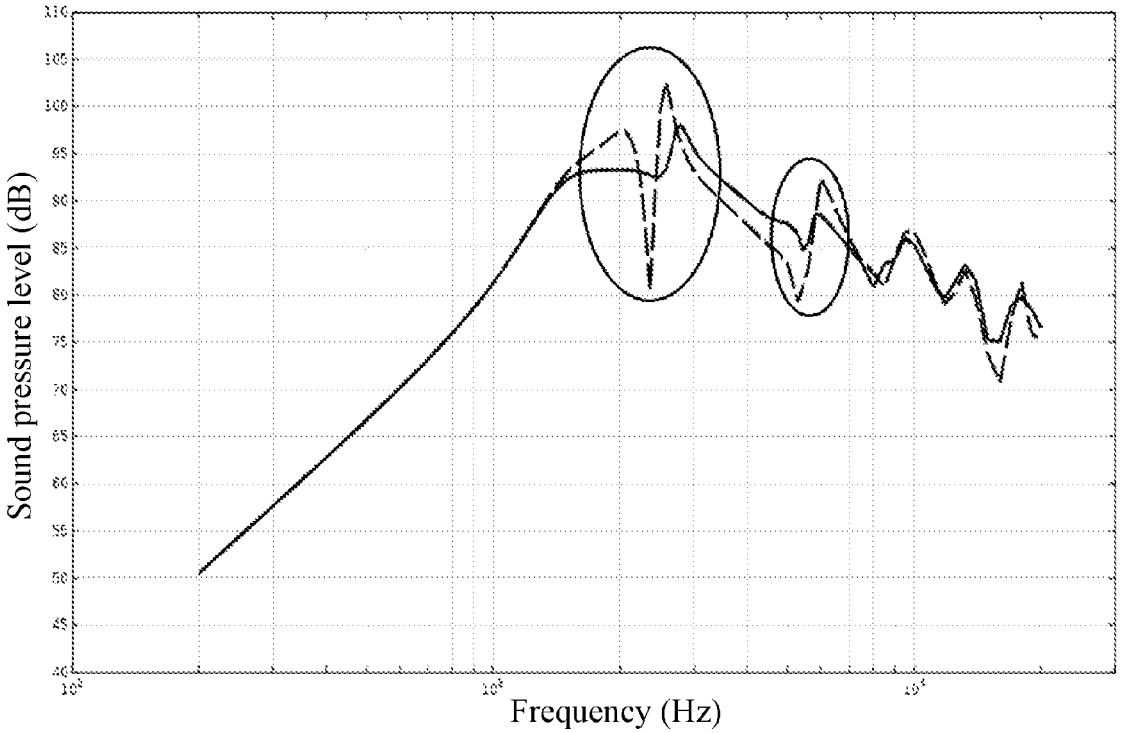
FIG. 8 is a frequency-response curve diagram of simulating a (treble) second driver.
Figure 9:
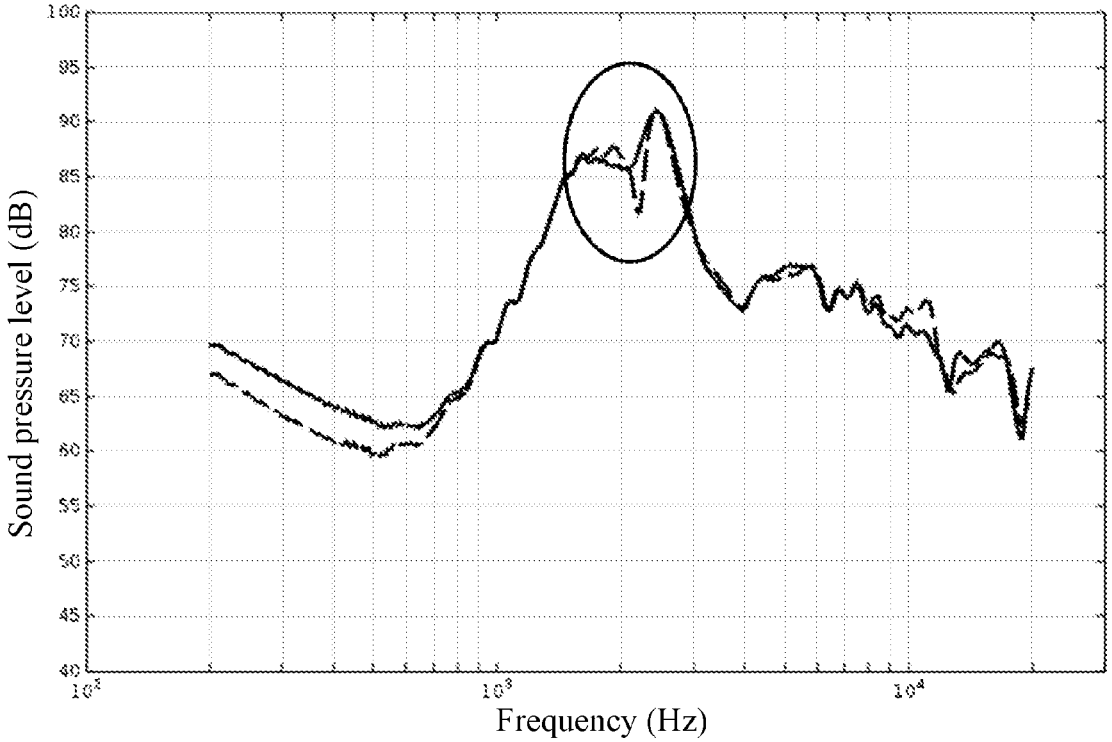
FIG. 9 is a frequency-response curve diagram of measuring a (treble) second driver.

By performing a simulated test by replacing the sound diffuser 30 in FIG. 1 with the hollow porous sound diffuser 30 in FIG. 7A and FIG. 7B, which shows a comparison of a frequency response of the second driver 20 (treble) between a perforated sound diffuser 30 and an imperforate sound diffuser 30 at a location that is one meter away from a horizontal middle point, as shown in FIG. 8 and FIG. 9, FIG. 8 is a frequency-response curve diagram of simulating a (treble) second driver 30. A solid line "-" indicates the hollow porous sound diffuser 30 with damping layers in FIG. 7A and FIG. 7B; a dashed line "---" indicates the imperforate sound diffuser 30 in FIG. 1. FIG. 9 is a frequency-response curve diagram of measuring a (treble) second driver 20. A solid line "-" indicates the hollow porous sound diffuser 30 with damping layers in FIG. 7A and FIG. 7B; a dashed line "---" indicates the imperforate sound diffuser 30 in FIG. 1.

It can be learned from simulated sound pressure level curves in FIG. 8 that, the hollow porous sound diffuser with damping layers can effectively eliminate a valley at 2.3 kHz and improve a valley at 5.4 kHz, so that the sound pressure level curves are easier, thereby helping to design the sound diffuser 30 of the speaker 1. It may be learned from the measured curve in FIG. 9 that a measurement result is basically consistent with a simulation result. It can be learned from a further analysis that the valleys at 2.3 kHz and 5.4 kHz are caused by coupling sound fields of treble and bass at the outer diameter of the sound diffuser 30. The openings 313*a*, 313*b*, 313*c*, 313*d*, 313*f*, and 313*e* are provided in the first diffusion surface 31 (bass) of the sound diffuser 30, and damping layers are added, so that the sound diffuser 30 becomes a Helmholtz resonator with damping layers, a sound transmission path of a sound production space of the first driver 10 (bass) is changed, and then the valley at 2.3 kHz is eliminated and the valley at 5.4 kHz is improved. It is noteworthy that damping control at locations of the openings 313*a*, 313*b*, 313*c*, 313*d*, 313*f*, and 313*e* in the first diffusion surface 31 of the sound diffuser 30 is very important. The optimal control effect cannot be achieved if the damping force is excessively large or excessively small. If the damping force is excessively large, it means that the first diffusion surface 31 (bass) of the sound diffuser 30 is rigid, and a sound cannot enter into the sound diffuser 30; if the damping force is excessively small, most of the sound radiated into the sound diffuser 30 is radiated back into an original sound field, effective coupling cannot occur, and the optimal effect cannot be achieved. Therefore, the damping at the locations of the openings 313*a*, 313*b*, 313*c*, 313*d*, 313*f*, and 313*e* needs to be properly adjusted, so as to achieve the optimal effect.

According to the speaker 1 and the sound diffuser 30 thereof of this disclosure, sound waves from both the first driver 10 and the second driver 20 can be simultaneously diffused, and the mutual impact between sound fields in the two sound production spaces of the first driver 10 and the second driver 20 can be reduced to the minimum, so that an optimal acoustic characteristic is achieved for the speaker 1.

Although this application is disclosed above by using the embodiments, the embodiments are not used for limiting this application. Any person skilled in the art may perform some modifications and improvements without disobeying the spirit and scope of this application. Therefore, the protection scope of this application should be subject to the scope defined by the claims.

What is claimed is:

1. A sound diffuser, applied to a speaker, and the sound diffuser comprising:

a first diffusion surface, facing toward a first driver, wherein the first diffusion surface comprises a first central area with a circular protrusion, a first outer ring region, and a first concave ring region located between the first central area and the first outer ring region; and a second diffusion surface, facing toward a second driver, wherein the second diffusion surface comprises a circular dish surface protuberant from center outwards, wherein the first diffusion surface has an opening and the second diffusion surface is free from any opening, and wherein the sound diffuser is coaxially located between the first driver and the second driver, and the first driver and the second driver respectively generate different sound frequencies.

2. The sound diffuser according to claim 1, wherein the first driver comprises a first folding ring, wherein a vertical distance between the first diffusion surface and the first folding ring is equal to or greater than a maximum physical stroke generated by the first folding ring.

3. The sound diffuser according to claim 2, wherein the second diffusion surface comprises a second central area, which is a circular protrusion, and a diameter of the first central area of the first diffusion surface is greater than the second central area of the second diffusion surface.

4. The sound diffuser according to claim 3, wherein the second diffusion surface has a second concave ring surface, and a diameter of the second concave ring surface is less than a diameter of the first concave ring region of the first diffusion surface.

5. The sound diffuser according to claim 2, wherein the second diffusion surface comprises a second central area, which is protuberant in a pointed cone.

6. The sound diffuser according to claim 2, wherein the second diffusion surface comprises a second central area, which is protuberant in a straight cone.

7. The sound diffuser according to claim 2, wherein the second diffusion surface comprises a second central area, which is protuberant in a circular convex cone.

8. The sound diffuser according to claim 2, wherein the sound diffuser is hollow, and the first diffusion surface has a plurality of openings.

9. The sound diffuser according to claim 8, wherein inner surfaces or outer surfaces of the plurality of openings of the first diffusion surface comprise damping layers.

10. A speaker, comprising:

a first driver;

a second driver, wherein a sound frequency generated by the second driver is different from that of the first driver; and a sound diffuser according to claim 1.

* * * * *